US005399041A

United States Patent [19]

Chiswell

[11] Patent Number: 5,399,041

[45] Date of Patent: Mar. 21, 1995

[54] WRITING INSTRUMENT BARREL AND METHOD OF FORMING A WRITING INSTRUMENT

[75] Inventor: Edgar B. Chiswell, Greenville, S.C.

[73] Assignee: BIC Corporation, Milford, Conn.

[21] Appl. No.: 162,837

[22] Filed: Dec. 3, 1993

Related U.S. Application Data

[63] Continuation of Ser. No. 937,299, Aug. 28, 1992, abandoned.

[51] Int. Cl.[6] ..... B43K 5/02; B43K 7/02; B43K 7/08

[52] U.S. Cl. ..... 401/209; 401/88; 401/96; 401/34; 401/199; 401/222; 401/241; 401/292

[58] Field of Search ..... 401/96, 88, 97, 209, 401/292, 222, 34, 199, 241

[56] References Cited

U.S. PATENT DOCUMENTS

| | | | |
|---|---|---|---|
| 461,911 | 10/1891 | Blaisdell . | |
| 620,051 | 2/1899 | Rakestraw . | |
| 674,851 | 5/1901 | Bremer . | |
| 679,264 | 7/1901 | Pedley . | |
| 703,304 | 6/1902 | Rakestraw . | |
| 845,320 | 2/1907 | Smith . | |
| 1,222,152 | 4/1917 | Smith . | |
| 1,233,815 | 7/1917 | Smith | 401/97 |
| 1,253,126 | 1/1918 | Bellamy . | |
| 1,396,060 | 11/1921 | Richter et al. . | |
| 1,772,309 | 8/1930 | Forssman . | |
| 1,798,003 | 3/1931 | Sitzler . | |
| 2,310,632 | 2/1943 | Hatfield | 401/88 |
| 2,464,436 | 10/1946 | Cox . | |
| 2,469,049 | 3/1947 | Miller . | |
| 2,734,838 | 2/1956 | Clancy et al. . | |
| 2,734,839 | 2/1956 | Clancy et al. | 401/96 X |
| 3,010,862 | 11/1961 | Basche . | |
| 3,102,634 | 9/1963 | Borisof | 401/96 |
| 3,416,869 | 12/1968 | Wittnebert et al. | 401/209 |
| 4,019,822 | 4/1977 | Matsumoto et al. | 401/96 |

FOREIGN PATENT DOCUMENTS

| | | | |
|---|---|---|---|
| 325923 | 1/1988 | European Pat. Off. | 401/88 |
| 0325923 | 8/1989 | European Pat. Off. . | |
| 1228971 | 9/1960 | France | 401/34 |
| 111229 | 6/1900 | Germany . | |
| 2109467 | 9/1972 | Germany | 401/34 |
| 257296 | 2/1928 | Italy | 401/34 |
| 19579 | 10/1901 | United Kingdom | 401/88 |
| 637331 | 5/1950 | United Kingdom | 401/34 |
| 9111334 | 8/1991 | WIPO | 401/96 |

OTHER PUBLICATIONS

Signs & Symbols catalog, copyright 1991.

Exhibit A (Sample Pen from Signs & Symbols catalog, copyright 1991).

*Primary Examiner*—Steven A. Bratlie

*Attorney, Agent, or Firm*—Peter G. Dilworth; Rocco S. Barrese; Joseph J. Catanzaro

[57] ABSTRACT

An writing instrument having an elongated tubular body formed from a thin sheet of material being rolled upon itself. A marking substance positioned within a bore of the body is prevented from leaking through the body by the application of a coating to at least one side of the sheet so that a lining is formed in the bore.

20 Claims, 4 Drawing Sheets

FIG. 1
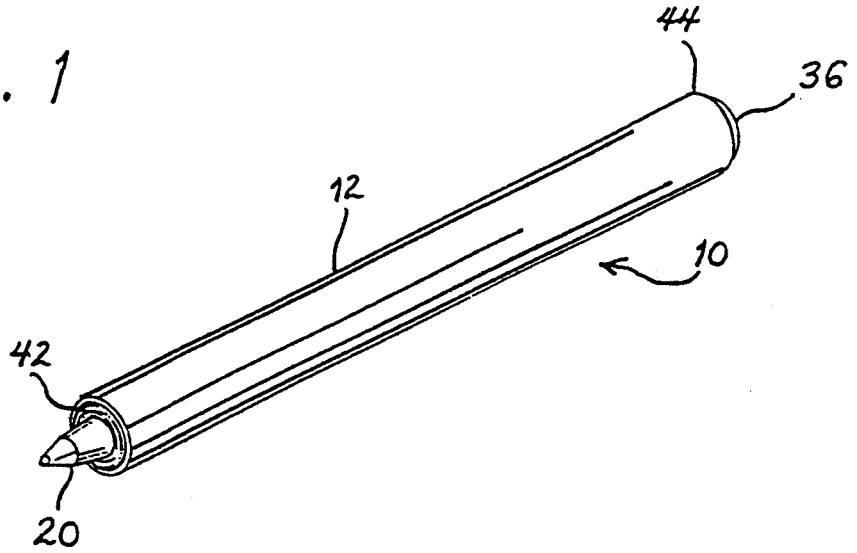
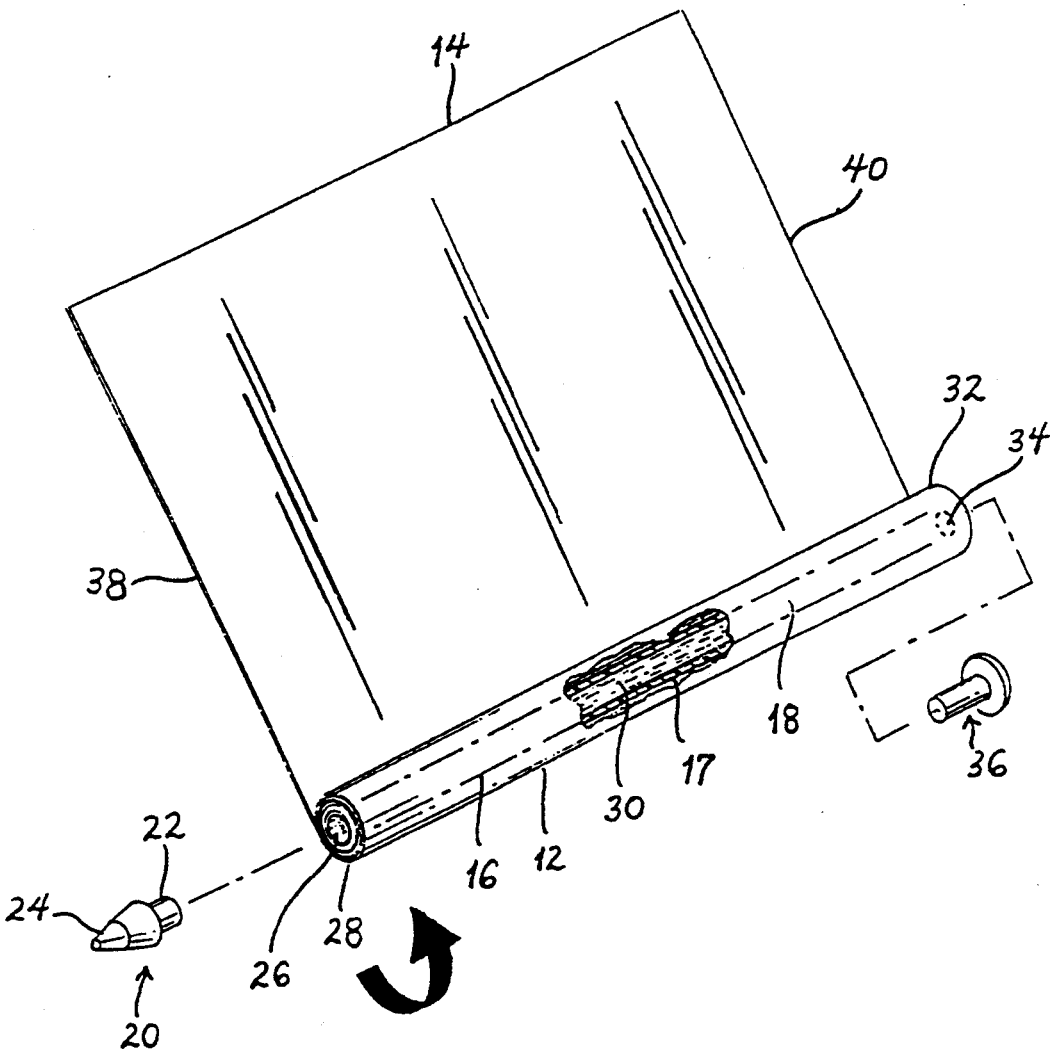
FIG. 2

WRITING INSTRUMENT BARREL AND METHOD OF FORMING A WRITING INSTRUMENT

This is a continuation of application Ser. No. 07/937,299, filed on Aug. 28, 1992, now abandoned.

BACKGROUND OF THE INVENTION

FIELD OF THE INVENTION

This invention relates to writing instruments and more particularly, this invention relates to the barrel portion of a writing instrument and a method of constructing a writing instrument.

DISCUSSION OF THE RELATED ART

In the past, writing instruments, such as pencils, have been made by winding a sheet material around a solid core such as a graphite composition commonly known as lead or crayon. Other similar instruments have been made using a wax based substance such as those used for so-called china markers where the sheet material used for wrapping the marking material could be peeled away or sharpened with a knife to continually expose new marking material. These types of marking or writing instruments have been known and are disclosed in, for example, U.S. Pat. No. 2,469,049 to Miller.

However, none of these prior writing instruments are suitable for use with a marking or writing material in a liquid form such as is used in ink pens and felt tip markers. Previously, the only way to accommodate such a writing material was to provide a separate structural container such as a cartridge or tubular shaped container, typically made of plastic or metal.

The novel writing instrument according to the present invention obviates the disadvantages encountered in the prior art and discloses an instrument which is easy to manufacture and efficient to use, which eliminates unnecessary structure required by prior art devices. The instrument incorporates many features including a sheet of material which may have a lining which avoids the need for providing separate conventional ink cartridges or inserts.

SUMMARY OF THE INVENTION

The present invention relates to a writing instrument having an elongated tubular barrel which is formed by rolling a thin sheet upon itself thereby forming an inner bore therethrough. The material of which the barrel is constructed is preferably a fibrous material such as paper. A lining may be applied to the thin sheet to prevent the writing substance from leaking therethrough and a writing tip is provided in communication with the writing substance. Coupling means such as, for example, friction fitting, adhesives or the like are provided on the writing tip for coupling to a first end of the elongated barrel. The coupling means may include, for example, a tapered writing substance receiving end such that when the writing tip is inserted into the opening at the first end, an interference or friction fit holds the writing tip in place. An opening at the other end of the elongated barrel is sealed by any suitable sealing means, such as, for example, a vented plug inserted in the opening.

The present invention further relates to a method for forming a writing instrument by applying a coating to a portion of at least one side of a thin, sheet material, drying the coating, rolling the sheet material upon itself to form an elongated tubular barrel having an inner wall defining a longitudinal bore therethrough, such that the inner wall is lined with the coating, inserting a writing tip into the bore at a first end of the elongated tubular barrel, and inserting a sealing means into the bore at a second end of the elongated tubular barrel.

An advantage of the above described writing instrument of the present invention is that the writing substance is supplied directly to the body so that additional process steps of making and filling separate cartridges with a writing substance and then inserting those cartridges are avoided.

BRIEF DESCRIPTION OF THE DRAWINGS

The foregoing advantages and features of the invention will become more readily apparent and may be understood by referring to the following detailed description of illustrative embodiments of the writing instrument, taken in conjunction with the accompanying drawings, in which:

FIG. 1 shows a perspective view of one embodiment of the present invention;

FIG. 2 shows a partially cut-away, exploded view of the embodiment of the present invention shown in FIG. 1;

DETAILED DESCRIPTION OF THE PREFERRED EMBODIMENTS

Figure 3:
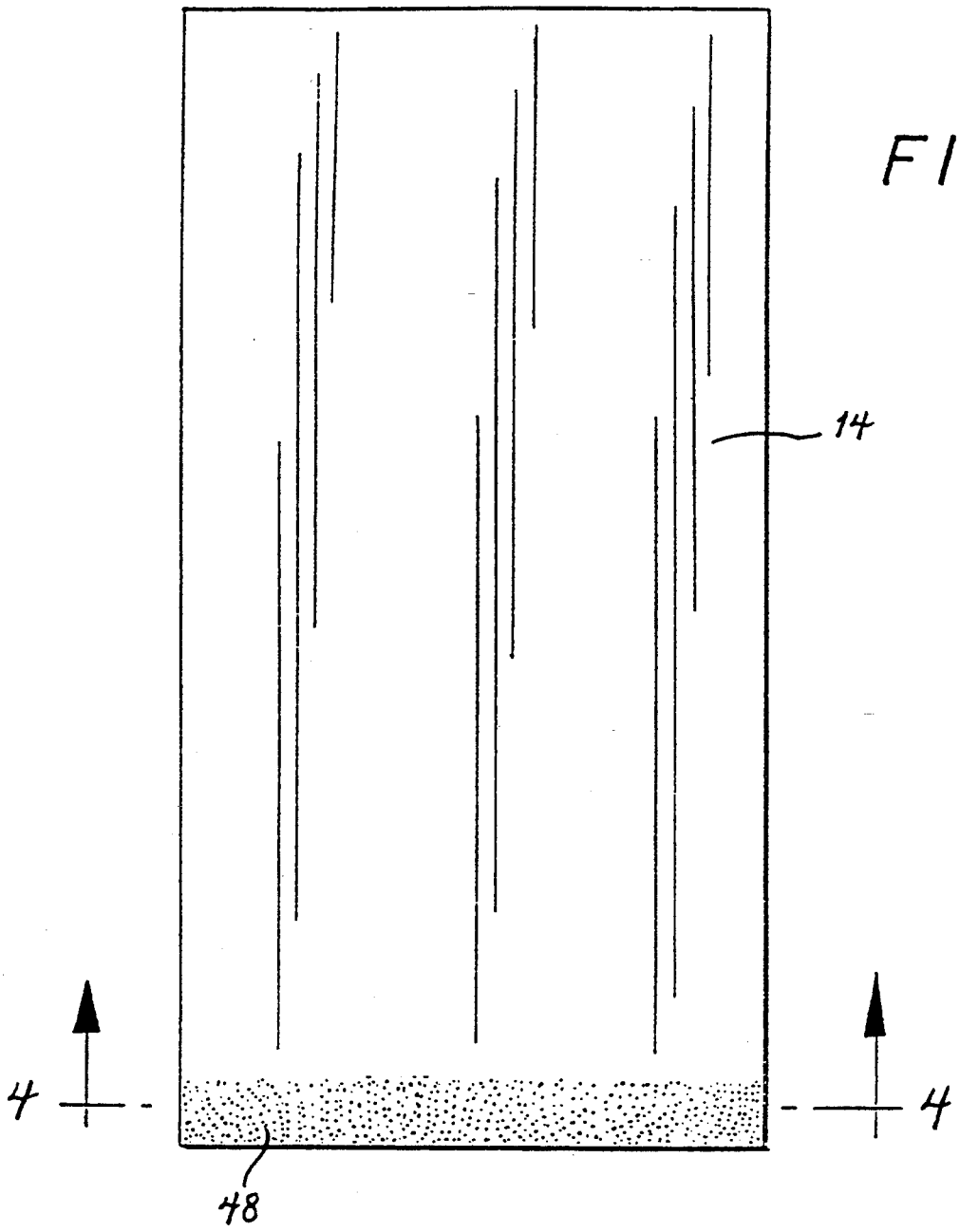
FIG. 3 shows a plan view of the thin sheet material of the present invention.

Referring now to the drawings, wherein like reference numerals designate identical or corresponding parts throughout the several views, and more particularly to the embodiment of the invention illustrated in FIGS. 1–4, writing instrument 10 is illustrated having a barrel shown as elongated tubular body 12 formed as a result of thin sheet material 14 being rolled upon itself. Sheet 14 may be any suitable material, preferably for example, cellulosic paper or any non-woven paper material. Inner wall 16 is thereby formed defining longitudinal bore 18. Writing tip 20 having writing substance receiving end 22 and writing substance delivery end 24 is securely coupled to elongated tubular body 12 at opening 26 of first end 28. Writing tip 20 may be coupled to elongated tubular body 12 by any suitable means such as, for example, by interference fit resulting from writing substance receiving end 22 having a diameter slightly larger than that of opening 26. Other suitable mounting means may obviously be substituted therefor.

A writing substance, for example, ink 30 is contained in longitudinal bore 18. While the generic term "ink", for the purposes used in this description, is used to describe the writing substance, it should be understood that the term "ink" includes: water based inks or solvent based inks, e.g., glycol based or glycol ether based inks. It is within the scope of the present invention that ink 30 may be omitted and supplied to longitudinal bore 18 at a later time by a separate supplier. In such an embodiment, writing instrument 10 could be shipped without ink and separate sealing means such as, for example, vented plug 36, could be provided for insertion after longitudinal bore 18 is filled with ink 30. Ink 30 may be delivered to longitudinal bore 18 by any suitable means such as, for example, by injection. Vented plug 36 is then inserted in opening 34 at second end 32 of elongated tubular body 18.

Thin sheet material 14 has two substantially parallel edges 38 and 40 so that when thin sheet material 14 is rolled upon itself to form elongated tubular body 18, flat ends 42 and 44 are formed. Prior to rolling, sheet material 14 may have graphics or text pre-printed thereon such that when tubular body 18 is formed the graphics or text will be visible. Such printing may include slogans, symbols, and organization logos, among others.

Furthermore, it is contemplated that sheet material 14 may be embossed or coated on what will become its outer surface to provide a textured surface which enhances the grip and feel of the writing instrument. The addition of the textured surface to the sheet material 14 also reduces the amount of sheet material necessary to construct the writing instrument. The coating of embossed material may be any suitable coating which is flexible to permit rolling of sheet material 14.

Referring now to FIG. 3, which shows thin sheet material 14 of the present invention having lining means such as, for example, coating 48 which could be made of a typical polymeric lining material. The lining preferably contains components that maintain the liquid inks in body 18 while being compatible with the main carrier component of the ink. For example, polyethylene and polypropylene coating materials may also be used. Coating 48 is applied to one side of sheet material 14 so that when thin sheet material 14 is rolled upon itself lining 17 is formed along inner wall 16 (FIG. 2) of elongated tubular body 12. Coating 48 may be applied in a strip or may cover any length of the side it is applied to. By providing such a barrier, ink 30 (FIG. 2) is prevented from leaking through thin sheet material 14.

Figure 4:
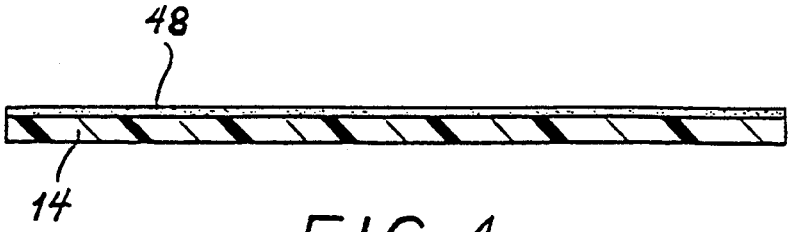
FIG. 4 shows the view taken along section 4—4 of FIG. 3.

Referring now to FIG. 4, coating 48 is shown applied to thin sheet material 14. Any suitable known application method may be used to apply coating 48, for example, spreading or spraying with subsequent drying taking place either naturally or by known drying means. Coating 48 is preferably a thin pliable layer, therefore allowing for rolling of thin sheet material 14. It is within the scope of the present invention that coating 48 may also serve as an adhesive, holding thin sheet material 14 in its rolled position. Alternatively, any conventional suitable adhesive means may be used, if needed, to retain the shape of elongated tubular body 50. For example, adhesives of the muselage or starch type may also be used.

Figure 5:
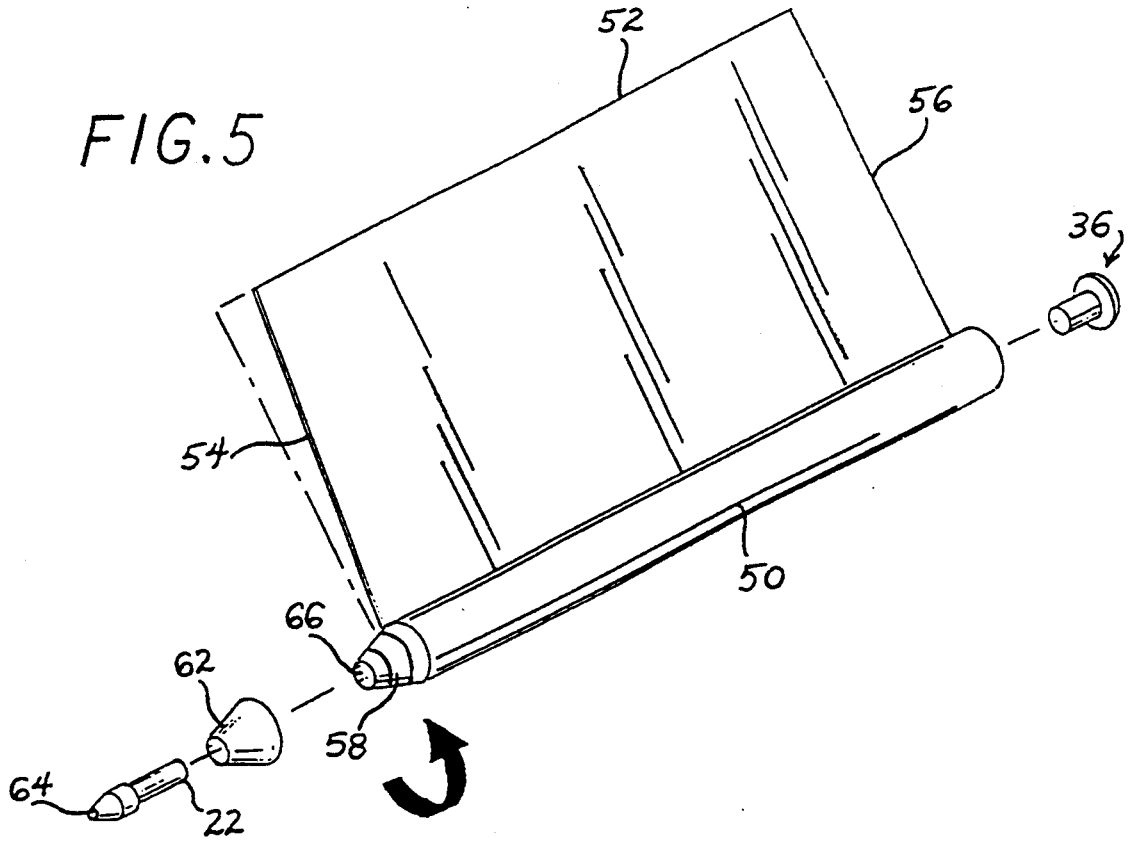
FIG. 5 shows an exploded view of an alternate embodiment of the present invention.

Referring now to the embodiment of the invention illustrated in FIG. 5, wherein elongated tubular body 50 is formed from thin sheet material 52 having one tapered edge 54 and one straight edge 56. Conical end 58 is formed at the tapered edge side 54 of thin sheet material 52 as the material is rolled upon itself. Vented plug 36 is inserted in the fiat end side 56 of elongated tubular body 50. Conical end cap 62 may be removably fitted over conical end 58. Alternatively, conical end cap 62 may be omitted. A writing tip such as, for example, ball point tip 64 is coupled to elongated tubular body 50 by coupling means on writing substance receiving end 22 in opening 66. The coupling means on writing substance receiving end 22 of ball point tip 64 may be of any suitable means such as, for example, by interference fit resulting from writing substance receiving end 22 having a diameter slightly larger than that of opening 66.

Figure 6:
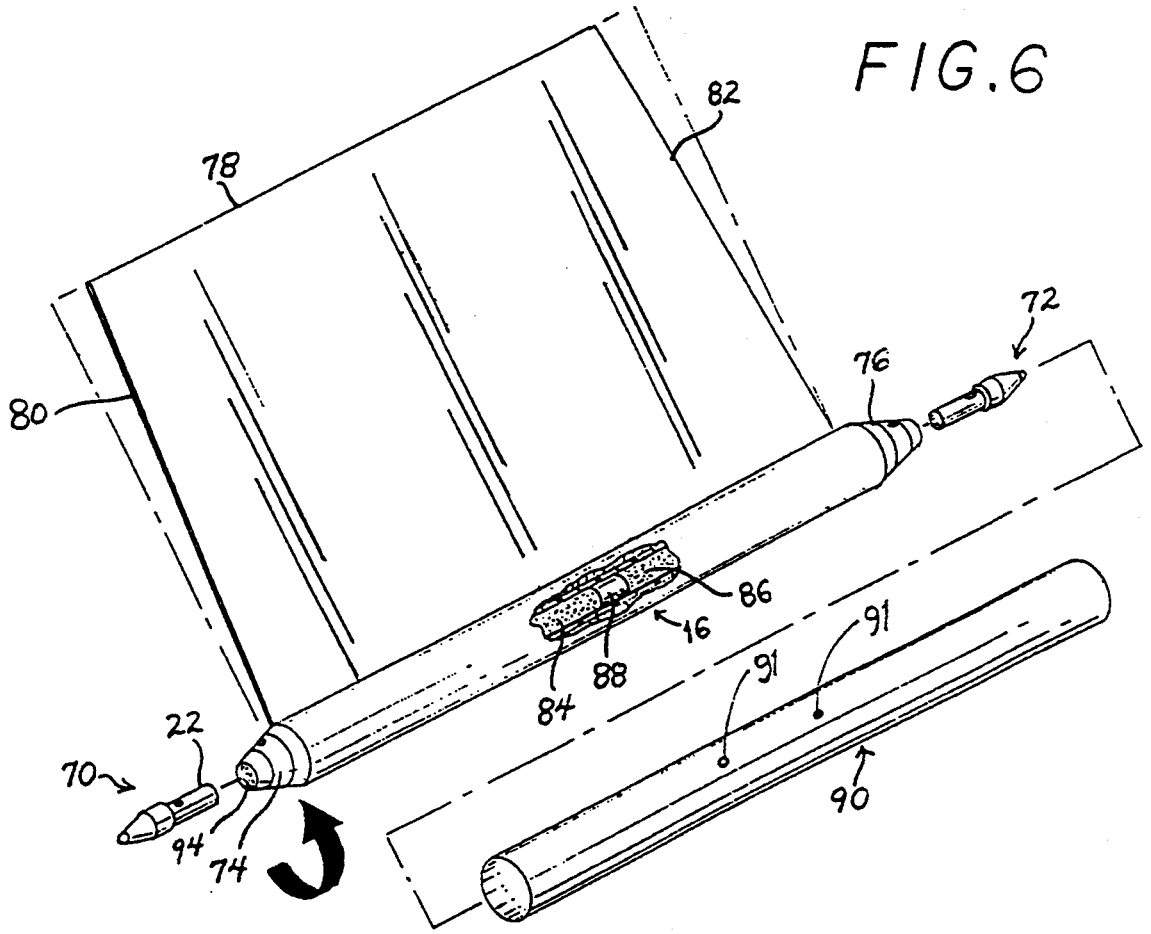
FIG. 6 shows a partially cut-away, exploded view of another alternate embodiment of the present invention.

Referring now to the embodiment of the invention illustrated in FIG. 6, writing instrument 68 is shown having two writing tips 70 and 72. Conical ends 74 and 76 for receiving writing tips 70 and 72 are formed from thin sheet material 78, with substantially non-parallel tapered edges 80 and 82, being rolled upon itself. Inner wall 16 is shown surrounding porous ink-retainers 84 and 86 and barrier 88. Porous ink retainers 84 and 86 may be of any suitable known felt-marker types. Barrier 88 may be any suitable sealing means such as, for example, a cylindrical plug or the like made of rubber. Barrier 88 provides a break between porous ink retainers 84 and 86 to prevent the flow of ink therebetween. Sleeve 90 may be provided to cover body 68 and may be slid over body 68 or shrink fitted by, for example, heat shrinking or similar known processes. Additionally, sleeve 90 may be provided with pre-printed text and/or graphics including messages, slogans, organization or individual names, symbols or the like. Such printing and graphics may be arranged so that the same are readily visible on the exterior of the writing instrument. A vent hole 91 may be provided on both sides adjacent barrier 88 to facilitate the flow of ink.

Figure 7:
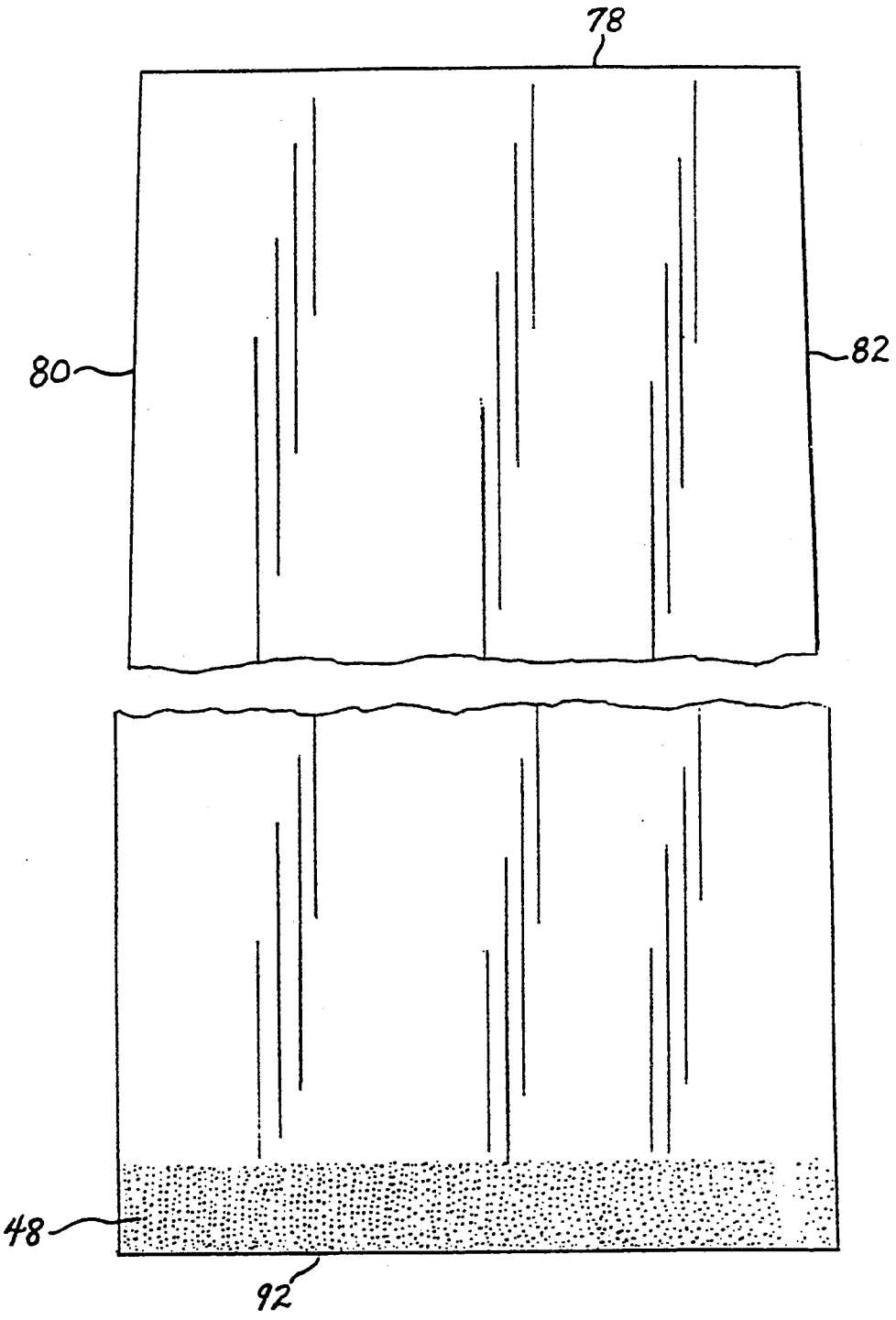
FIG. 7 shows a broken, plan view of the sheet material of the present invention.

Referring now to FIG. 7, thin sheet material 78 is shown with a lining material such as, for example, coating 48 applied along broad end 92. Thin sheet material 78 has tapered edges 80 and 82 for forming conical ends 74 and 76 (as seen in FIG. 6). Coating 48 may be applied to broad end 92 in a width corresponding to at least one circumference of bore 94 to assure full coverage of inner wall 16. The width of coating 48 may, however, be any multiple greater than the circumference of inner wall 16 to provide additional protection against leakage of ink 30.

While the invention has been particularly shown and described with reference to the preferred embodiments, it will be understood by those skilled in the art that various modifications in form and detail may be made therein without departing from the scope and spirit of the invention. Accordingly, modifications such as those suggested above, but not limited thereto, are to be considered within the scope of the invention.

What is claimed is:

1. A writing instrument comprising:

an elongated tubular body having a first end and a second end, said tubular body comprising a thin sheet of material rolled upon itself forming an inner bore;

a writing substance disposed within said inner bore, such that said sheet of material at said inner bore is in contact with said writing substance to form a container for said writing substance; and a writing tip in communication with said writing substance coupled to said first end of said elongated tubular body in said bore.

2. A writing instrument according to claim 1, further comprising sealing means for sealing said bore at said second end of said elongated tubular body.

3. A writing instrument according to claim 1, wherein said thin sheet of material further comprises at least two edges substantially parallel in relation to each other such that when said sheet material is rolled upon itself said elongated tubular body is formed having two substantially flat end portions.

4. A writing instrument according to claim 1, wherein said thin sheet of material further comprises at least two edges, at least one of said edges being angled in relation to said other edge such that when said thin sheet is rolled upon itself said elongated tubular body is formed having at least one conical shaped end portion for coupling with said writing tip.

5. A writing instrument according to claim 1, further comprising a sleeve mountable on said elongated tubular body for covering said tubular body.

6. A writing instrument comprising:

an elongated tubular body having a first end and a second end, said tubular body comprising a thin sheet of material rolled upon itself forming an inner bore;

lining means on said sheet of material at said inner bore;

a writing substance disposed within said inner bore and being substantially enclosed within said lining means, such that said lining means is in direct contact with said writing Substance to form a container for said writing substance; and a writing tip in communication with said writing substance coupled to said first end of said elongated tubular body in said bore.

7. A writing instrument according to claim 6, wherein said lining means comprises a substantially liquid-impermeable material.

8. A writing instrument according to claim 7, wherein said impermeable material is applied to at least one side of an edge of said thin sheet for preventing leakage of said writing substance through said thin sheet.

9. A writing instrument comprising:

an elongated tubular body having a first end and a second end, said tubular body comprising a thin sheet of material rolled upon itself forming an inner bore;

at least one writing substance disposed within said inner bore, such that said sheet of material at said inner bore is in contact with said writing substance to form a container for said writing substance;

a first writing tip in communication with said writing substance removably coupled to said first end of said elongated tubular body in said bore; and a second writing tip in communication with said writing substance removably coupled to said second end of said elongated tubular body in said bore.

10. A writing instrument according to claim 9, wherein said writing substance is accessible by each of said writing tips.

11. A writing instrument according to claim 9, further comprising means disposed in said bore for sealably dividing said bore into a first writing substance containing compartment and a second writing substance containing compartment.

12. A writing instrument according to claim 11, further comprising a writing substance contained in each of said containing compartments such that said writing substance in said first compartment communicates with said first writing tip and said writing substance in said second compartment communicates with said second writing tip.

13. A writing instrument according to claim 12, wherein said writing substance is a tubular felt material impregnated with ink having an end adapted for extending into a receiving end of said first and second writing tips.

14. A writing instrument according to claim 9 further comprising means for lining said inner bore.

15. A method for forming a writing instrument comprising the steps of:

rolling a sheet material upon itself to form an elongated tubular body having a longitudinal bore therethrough;

inserting a writing tip into said bore at a first end of said elongated tubular body; and filling said bore with a writing substance, such that said writing substance is in substantial contact with said sheet material.

16. The method of forming a writing instrument according to claim 15, further comprising the step of inserting a sealing means into said bore at a second end of said elongated tubular body.

17. A method for forming a writing instrument according to claim 15, further comprising the step of sliding a sleeve over said elongated tubular body.

18. A method for forming a writing instrument comprising the steps of:

applying a leak resistant coating to a portion of at least one side of a thin sheet material;

rolling said sheet material upon itself to form an elongated tubular body having a longitudinal bore therethrough, such that an inner wall is coated with said leak resistant coating;

inserting a writing tip into said bore at a first end of said elongated tubular body; and filling said bore with ink, such that said ink is in substantial contact with said coating.

19. The method of forming a writing instrument according to claim 18, further comprising the step of drying said leak resistant coating.

20. The method of forming a writing instrument according to claim 18, further comprising the step of inserting a sealing means into said bore at a second end of said elongated tubular body.

* * * * *